United States Patent [19]

Schyns

[11] 3,979,930

[45] Sept. 14, 1976

[54] METHOD AND AN APPARATUS FOR TREATING TEXTILE MATERIALS

[75] Inventor: Pierre Schyns, Uccle, Belgium

[73] Assignee: Etablissements Callebaut-du Blicquy S.A., Forest, Belgium

[22] Filed: Oct. 8, 1974

[21] Appl. No.: 513,193

[30] Foreign Application Priority Data

Oct. 9, 1973 Belgium ..... 136481

[52] U.S. Cl. ..... 68/5 E; 34/242; 118/62

[51] Int. Cl.[2] ..... D06B 3/04

[58] Field of Search ..... 68/5 D, 5 E, DIG. 5, 68/177, 178; 34/242; 118/62

[56] References Cited

UNITED STATES PATENTS

| | | | |
|---|---|---|---|
| 2,598,000 | 5/1952 | Knopp et al. | 34/242 X |
| 3,099,146 | 7/1963 | Yamawaki | 68/5 E X |
| 3,349,578 | 10/1967 | Greer et al. | 68/5 E |
| 3,471,605 | 10/1969 | Matsui et al. | 68/177 X |
| 3,728,076 | 4/1973 | Fleissner | 68/5 D X |
| 3,762,187 | 10/1973 | Fleissner et al. | 68/5 E |
| 3,835,671 | 9/1974 | Fleissner et al. | 68/DIG. 5 |

FOREIGN PATENTS OR APPLICATIONS

| | | | |
|---|---|---|---|
| 660,928 | 7/1965 | Belgium | 68/5 E |

*Primary Examiner*—Philip R. Coe
*Attorney, Agent, or Firm*—Sughrue, Rothwell, Mion, Zinn and Macpeak

[57] ABSTRACT

This invention relates to an apparatus for treating materials.

The apparatus comprises a chamber defining a treatment space for treating the textile materials and having an inlet for introducing said textile materials to be treated and an outlet for extracting the treated materials. An endless conveyor traverses the treatment chamber, extending through said inlet and said outlet and conveying said textile materials in said treatment chamber. Means for feeding a treatment agent into said treatment space and means for creating at the inlet and/or said outlet of said treatment chamber, a pressure zone and/or a temperature zone to maintain within the treatment space a gas pressure and/or a temperature higher than that and/or those existing outside said treatment chamber are provided.

The apparatus avoids the undersireable flows of gas at said inlet and outlet of said treatment chamber and allows regular treatment operations of the textile materials.

4 Claims, 2 Drawing Figures

METHOD AND AN APPARATUS FOR TREATING TEXTILE MATERIALS

The present invention relates to an apparatus for treating textile materials such as fabric, yarn, cable.

A treating apparatus for treating textile materials comprises a treatment space through which the textile material passes, the textile material entering the treatment space through an inlet and being transported by an endless conveyor belt to leave the treatment space through an outlet opposite to the inlet. The textile material undergoes the action of at least one treating agent in the treatment space. A method for treating textile materials comprises moving the textile material throughout a treatment space from an inlet and an outlet opposite to the inlet and applying at least one treatment agent in the treatment space.

In the particular case of dyeing and bleaching operations of textile materials, the treatment space has to contain steam constantly at a temperature of at least 100° to ensure uniform fixing of the dyeing and bleaching agents to the textile material. Owing to the gas flow upon occurrence of leakages of steam at the inlet and the outlet of the treatment space, it is difficult to maintain therein steam at a pressure slightly higher (from 5 to 10%) than the atmospheric pressure and at a temperature of at least 100°C. The dyeing and bleaching operations of textile materials are then difficult and irregular.

The object of the present invention is to provide an apparatus for treating textile materials which allow undesirable gas flow at the inlet and the outlet of the treatment space to be eliminated and particularly capable of ensuring regular and efficient dyeing and bleaching operations.

The apparatus comprises means for creating at the inlet and/or the outlet of the treatment space a zone of pressures and/or temperatures capable of maintaining in this space a gas pressure and/or temperature higher than that and/or those existing outside the space. The method provides at the inlet and/or the outlet of the treatment space a zone of pressures and/or temperatures capable of maintaining in this space a gas pressure and/or temperature higher than that and/or those existing outside the space.

According to a first embodiment of the invention, in order to obtain the zone of pressures and/or temperatures a chamber is provided which is arranged facing the inlet and/or the outlet of the treatment space, communicates with this inlet and/or this outlet and contains a pressurized gas.

According to a second embodiment of the invention, a gas shield is formed at the inlet and/or the outlet of the treatment space in order to create the zone of pressures and/or temperatures and thus to oppose gas flow towards the inside of the treatment space through this inlet and/or this outlet. Depending upon the circumstances, the gas shield may be vertical and directed upwards or skew and directed downwards and towards the inlet and/or the outlet of the treatment space. Preferably the gas shield is produced by a gas blowing nozzle. For maximum efficiency, the gas shield is directed besides the inlet and/or the inner side of the outlet within the treatment space.

In known apparatus of the above kind, the textile material is fed to the conveyor belt by purely mechanical driving means which includes driving rollers having distribution members. These feeding mechanisms for textile material are constructionally complex and difficult to maintain.

Another object of the invention is to provide apparatus for treating textile material in which the textile material is fed to the endless conveyor tape through simple means and by a feed fluid flow.

Accordingly, in the apparatus according to the invention the textile material is thrown by a fluid flow which feeds and supplies the textile material to this conveyor tape.

In order to arrange the textile material in successive alternating folds on the conveyor belt and thus substantially to reduce the length the treatment space of the new treatment apparatus, the nozzle which ejects or throws the textile material is alternatingly displaced transverse to the feed direction of the textile material.

In a particularly advantageous embodiment of the invention, the fluid flow used to eject the textile material onto the conveyor tape, is employed for creating the above-mentioned pressure and/or temperature gradient at the inlet of the treatment space.

According to a feature of the invention, the zone of temperatures at the inlet and/or the outlet of the treatment space is formed by a thermal shield created by heating means located at this inlet and/or outlet. Preferably, the heating means concerned is formed by adjustable radiating plates.

According to another feature of the invention, which feature allows the zone of temperatures to be created at the inlet of the treatment space, outside this space and adjacent to the inlet the gas phase is sucked from above the textile material throughout a suction hood.

Another object of the invention is to provide a conveyor tape for transporting the textile material. The conveyor tape according to the invention consists of a non-metal material which does not conduct heat and is of low thermal inertia. In this connection the conveyor belt consists of glass fibre bound by polytetrafluoroethylene.

The invention will become more apparent from the following description of an embodiment thereof taken with reference to the accompanyng drawings wherein.

In the Figures the same reference numbers are used to indicate the same elements throughout.

Figure 1:
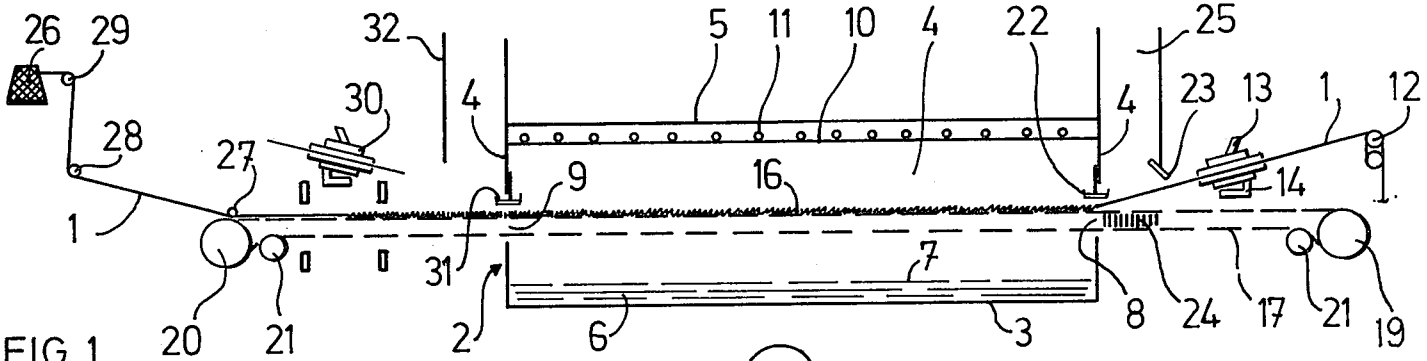
FIG. 1 is a vertical and longitudinal cross-section view of an apparatus for treating textile materials.
Figure 2:
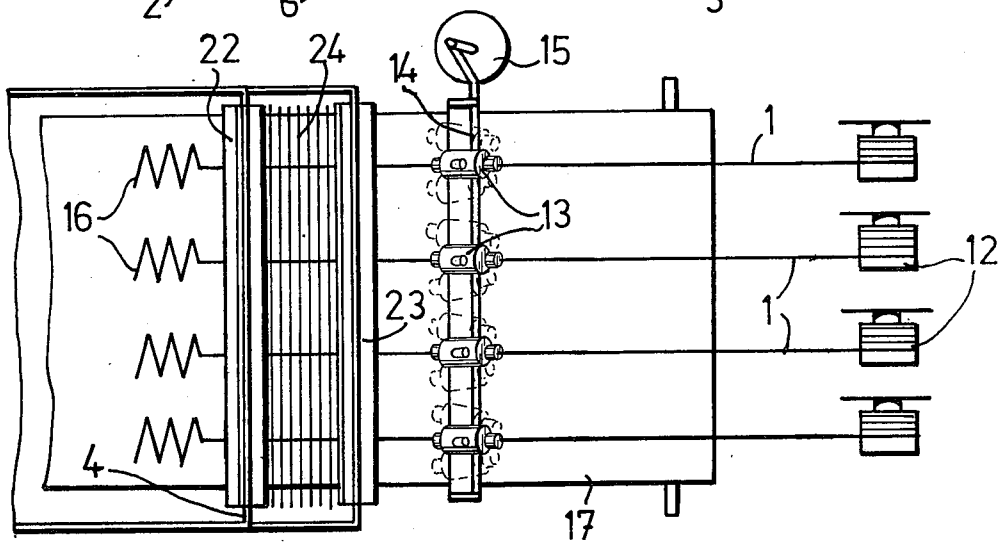
FIG. 2 is a partial plan view on a larger scale of the front part of the apparatus of FIG. 1.

The treatment apparatus as shown in the drawings serves, for example, to dye a textile material formed of yarns 1. The apparatus concerned may thus be employed for carrying out other treatments on textile materials in the form of yarns, fabric or cables.

The treatment apparatus substantially comprises a treatment space or basin 2 having a bottom 3, side walls 4 and a vault 5.

The bottom 3 and the side walls 4 of the treatment space 2 form a container containing an amount of water 6 constantly reaching a predetermined level 7. The amount of water 6 is heated by conventional heating means, not shown, the water is vaporized and steam if formed within the treatment space. Control means for monitoring the heating level of the amount of water 6 and control means for controlling the water supply up to the determined level 7 are provided to obtain the steam in the treatment space 2 at a pressure slightly higher than the ambient atmospheric pressure and at a temperature of at least 100°C.

The front side wall 4 of the treatment space 2 has an inlet opening 8 and the lateral rear wall 4 has an outlet opening 9 opposite thereto.

The vault 5 of the treatment space 2 has a dummy wall 10 and heating means 11 located between this vault 5 and this dummy wall 10 and serving to heat the upper part of the treatment space 2.

In the treatment space 2 textile materials are treated by making use of at least one suitable agent such as steam. The method and the material are the same for each yarn 1 and thus only the operations and the relative means for a single yarn 1 will be described below.

Each yarn 1 is supplied by a source not shown. The yarn 1 passes over two driving rollers 12 to be supplied to the inlet 8 of the treatment space 2. While descending towards the inlet 8, the yarn 1 passes a blowing and ejecting nozzle 13. The nozzle 13 is directed towards the inlet 8 and blows in that direction, i.e. towards the inlet 8, a flow of pressurized air supplied to the nozzle. The pressurized air flow feeds the yarn 1 to the inlet 8 and beside the inlet 8 within the treatment space 2.

In operation, each nozzle 13 may be alternatingly moved transversely to the general direction of movement of the yarn 1. This transversal movement of the nozzle 13 is imparted by a support 14 for the nozzle 13, this support effecting a reciprocating motion at uniform linear speed. In general, the support 14 is common to all the nozzles 13 and is driven by means of an eccentric 15, for example, The yarn 1 is projected by the nozzle 13 into successive alternate folds 16 within the treatment space 2, and on top of the conveyor belt 17. The latter conveys the yarn throughout the treatment space 2 and beyond. In the embodiment shown, the conveyor belt 17 is mounted on a control drum 19 and a turn-around drum 20 and is tensioned by tensioning cylinders 21. Preferably, the conveyor belt 17 consists of a non-metallic material which does not conduct heat and is of a low thermal inertia. For example, the conveyor belt 17 consists of glass fibres bound to each other by polytetrafluoroethylene. Moreover, the conveyor belt 17 extends horizontally from front side wall 4 to the rear side wall 4 so that it passes through the openings 8 and 9 in the side walls 4.

The air flow from each nozzle 13 directed towards the inlet 8 creates a zone of pressures which is localized at this inlet 8 and opposes the steam flow through the inlet 8 from the inside of the treatment space 2 towards the outside of this space 2. In this way, steam at a pressure slightly higher than the ambient atmospheric pressure is maintained in the treatment space.

Each nozzle 13 plays a double action. On the one hand, the nozzle 13 allows the yarn 1 to be ejected on the conveyor belt 17 by means of the air flowing from it. On the other hand, the nozzle 13 allows the air flow to be blown at the inlet 8 to create thereat a pressure zone thereby fluid sealing this inlet 8 and thus also effecting an efficient and uniform treatment of the yarn 1.

The assembly of the nozzles 13 practically forms an air shield to create the pressure zone at the inlet 8 of the treatment space 2. In the embodiment shown, the air shield, or more generally the gas shield, is obliquely directed downwards and toward the conveyor belt 17 above the yarns 1. In modified embodiments, the air shield, or the gas shield, may be vertically directed and oriented upwards.

At the inlet 8 of the treatment space 2, heating means are provided to create a temperature zone which strongly prevents losses of heat through the inlet 8 towards the outside of the treatment space from occurring and also allow steam to be maintained in the treatment space at a temperature of 100°C. In the shown embodiment, these heating means comprise radiating plates 22, 23, and 24 which may be adjustably positioned and radiate an adjustable amount of energy. The first radiating plate 22 is horizontally arranged above the conveyor belt and the yarn 1 at the inlet 8. The second radiating plate 23 is obliquely arranged above the conveyor belt 17 and the yarn 1 outside the treatment space 2 and at a distance from the first radiating plate 22. The third radiating plate 24 is in turn vertically mounted between the upper and lower runs of the conveyor belt 17 and longitudinally between the first and the second radiating plates 22 and 23, this third radiating plate 24 thus being below the yarn 1. The assembly of the three radiating plates 22, 23 and 24 creates at the inlet 8 and downstream of this inlet 8 on both sides of the yarn a zone of temperature producing hot air. This hot air is usually discharged upwards and is also sucked through a suction hood 25 mounted above the yarn 1 adjacent to the front side wall 4 of the treatment space 2.

While crossing the treatment space 2, the yarn 1 arranged in successive alternate folds on the conveyor belt 17 undergoes uniform treatment.

At the output 9 of the treatment space 2, the yarn 1 continues to be transported by the conveyor belt 17 and is then taken up for example by a winding bobbin 26 through guide rollers 27, 28 and 29.

At the outlet 9, nozzles 30 may be provided which are capable of providing a gas shield up to the outlet 9 and even beyond it to create a pressure zone which opposes, similar to that at the inlet 8, the passage of steam through the outlet 9 from the inside of the treatment space 2 towards the outside. Moreover, in the preferred embodiment a heating plate 31 is also provided at least at the outlet 9 above the yarn 1 to create a zone of temperature and mitigate against loss of heat throughout the outlet 9. A suction hood 32 is also located above the yarn 1 near the rear side wall 4 of the treatment space 2 to perform the same duties as those of the suction hood 25 at the inlet 8.

In the present embodiment, the means for creating the zone of pressure comprise the nozzles 13 which at the inlet 8 have the function of ejecting or projecting the yarn 1 and providing the air flow while at the outlet 9 are simply blowing nozzles of the gas flow. In other embodiments, at the inlet 8 separate nozzles may be provided for projecting the yarn 1, and for blowing the gas flow. In still further embodiments, the means concerned may comprise a chamber arranged facing the inlet 8 and/or the outlet 9, this chamber communicating with this inlet 8 and/or this outlet 9 and containing a pressurized, possibly heated gas.

In the embodiment described, the pressure zone at the inlet 8 and at the outlet 9 of the treatment space 2 is created by the gas blown by the nozzles 13 and 30, while the temperature zone is obtained by means of the radiation of the heating plates 22, 23, 24 and 31. In another embodiment, the zone of pressure and that of temperature simply consisting of a shield of gases previously heated before being fed to the blowing nozzles.

It should be noted that the invention is not exclusively limited to the embodiment shown and that modifications may be made in the shape, arrangement and constitution of certain elements used in carrying out the invention.

What we claim is:

1. An apparatus for treating textile materials comprising:

a. a chamber defining a treatment space for treating the textile materials, said chamber having an inlet for introducing said textile materials to be treated and an outlet for extracting the treated textile materials;

b. an endless perforated conveyor traversing said treatment chamber, extending through said inlet and said outlet for conveying said textile materials through said treatment chamber;

c. means for feeding at least one treatment agent into said treatment space;

d. a first nozzle arranged above said conveyor at the inlet to said treatment chamber and directed obliquely downwards and towards said inlet;

e. a second nozzle arranged above said conveyor in proximity to the outlet of said treatment chamber and directed obliquely downwards and towards said outlet;

f. means for feeding said first and second nozzles with gas under pressure;

g. means for feeding said textile materials into said first nozzle such that said textile materials are fed and projected onto said conveyor at said inlet through said first projecting nozzle and, wherein a gas shield is produced simultaneously with said feeding of textiles at said inlet by directing gas from said first nozzle to said inlet to prevent loss of treatment agent through said inlet from inside said treatment space; and h. wherein said gas from said second nozzle is directed towards said outlet to form a gas shield at said outlet through said conveyor and said textile materials in order to prevent loss of treatment agent through said outlet from inside said treatment space.

2. An apparatus as claimed in claim 1, wherein said first nozzle is displaced transversally to the projecting direction of said textile materials in order to arrange the latter in alternate successive folds on said conveyor.

3. An apparatus as claimed in claim 1, further including first adjustable radiating plates disposed relative to the perforated conveyor at a position prior to entry in said inlet, such that a thermal shield is created at said inlet through said perforated conveyor to prevent loss of heat through said inlet from inside said treatment space, and second adjustable radiating plates disposed relative to said perforated conveyor at a position subsequent to passage through said outlet, such that a thermal shield is created at said outlet through said conveyor and through said treated textile materials, in order to prevent loss of heat through said outlet from inside said treatment space.

4. An apparatus as claimed in claim 3 wherein a suction hood is arranged above said textile materials facing each set of radiating plates.

* * * * *